United States Patent [19]

Gallaro et al.

[11] Patent Number: 4,571,521

[45] Date of Patent: Feb. 18, 1986

[54] COLOR CRT WITH ARC SUPPRESSION STRUCTURE

[75] Inventors: Anthony V. Gallaro, Auburn; Mark A. Josephs, Seneca Falls, both of N.Y.

[73] Assignee: North American Philips Consumer Electronics Corp., New York, N.Y.

[21] Appl. No.: 525,758

[22] Filed: Aug. 23, 1983

[51] Int. Cl.[4] ..... H01J 29/80

[52] U.S. Cl. ..... 313/402; 313/407; 313/479; 313/481

[58] Field of Search ..... 313/479, 481, 402, 407

[56] References Cited

U.S. PATENT DOCUMENTS

| | | | |
|---|---|---|---|
| 3,961,221 | 6/1976 | Benda et al. | 313/561 |
| 4,061,945 | 12/1977 | Benda et al. | 313/481 |
| 4,145,162 | 3/1979 | Schiabez | 313/481 |
| 4,230,966 | 10/1980 | Compen | 313/481 |
| 4,302,063 | 11/1981 | Rudy | 445/55 |
| 4,403,170 | 7/1983 | Misono et al. | 313/479 |

FOREIGN PATENT DOCUMENTS

| | | | |
|---|---|---|---|
| 82555 | 7/1981 | Japan | 313/479 |
| 85253 | 5/1983 | Japan | 313/479 |

*Primary Examiner*—S. Leon Bashore
*Assistant Examiner*—Michael K. Boyer
*Attorney, Agent, or Firm*—John C. Fox

[57] ABSTRACT

A color cathode ray tube having a phosphor pattern on the mask and a window in the tube wall to allow external detection of the phosphor emissions, also incorporates arc limiting features including a high resistance coating in the neck region of the tube and a getter designed and placed to direct getter flash away from the neck, window and mask areas. Such a tube is useful, for example, for high resolution color displays having an automatic convergence feature.

6 Claims, 3 Drawing Figures

COLOR CRT WITH ARC SUPPRESSION STRUCTURE

BACKGROUND OF THE INVENTION

This invention relates to a color cathode ray tube (CCRT) having an arc suppression structure to minimize surge currents from the CCRT caused by internal arcing, and more particularly relates to such a CCRT having feedback features for an auto-convergence system.

An automatic convergence system has recently been developed for high resolution CCRT displays expected to have application in such demanding fields as computer aided design (CAD) and cartography. See ELECTRONIC PRODUCTS, May 12, 1983, p. 17. Essential to such an auto-convergence system are certain feedback features in the CCRT, which provide information on the location of the scanning electron beams to a computer, which then corrects any misconvergence of the beams. Such feedback features include a phosphor pattern on the back or gun side of the tube's aperture mask, and a window in the side of the tube. When struck by the scanning electron beams, the phosphor pattern emits radiation, some of which is transmitted through the window and detected by an externally placed photomultiplier tube.

The window must not only be transparent to the emitted radiation but also must be sufficiently conductive to prevent localized charge build-up, which could distort the adjacent potential field, resulting in disturbance of the electron beam paths. A suitable window structure is described and claimed in co-pending U.S. patent application Ser. No. 448,468, base issue fee paid Apr. 15, 1985, and assigned to the present assignee.

In addition the getter flash, a deposit of gas-adsorbing material essential to adequate life of the CCRT, must be distributed in a manner to avoid both the phosphor pattern on the back of the mask and the window, to assure an adequate signal to the photomultiplier tube. Such a distribution is achieved in a getter structure described and claimed in U.S. patent application Ser. No. 449,897, filed Dec. 15, 1982, also assigned to the present assignee.

However, the feedback CCRT shares a common problem with other CCRTs, that is, susceptibility to high surge currents caused by internal arcing. Such susceptibility to arcing is not surprising in view of typical operating potentials as large as 25 to 30 kilovolts, and the large potential differences between various tube components, especially the closely spaced gun electrodes. Steps are taken during manufacture to minimize arcing during later tube operation, especially the step of high voltage conditioning in which a voltage of 40 kilovolts or more is applied between the terminal high voltage electrode and the adjacent electrode of the electron gun to remove projections and foreign matter from the inter-electrode spacing. Despite this and other precautions, occasional arcing does occur, resulting in momentary surge currents as high as 400 amps, which can be devastating to electrical components outside the CCRT. Thus, numerous structures have been proposed to reduce or dissipate such surge currents inside the CCRT. (For internal high resistance coatings in the neck and funnel regions of the tube, see, for example, U.S. Pat. Nos. 2,829,292; 3,555,617; 3,961,221; 3,959,686; 4,249,107; 4,280,931 and German Pat. No. 2,634,102). (For discrete resistors between the getter wand and the gun, see, for example, U.S. Pat. Nos. 3,355,617; 4,101,803 and 4,255,689). (For a spark gap across such a resistor, see U.S. Pat. No. 4,234,816). (For discrete resistors between the internal conductive coating and the convergence cup, see, for example, U.S. Pat. No. 3,295,008 and British Pat. Nos. 1,353,872 and 1,448,223). (For discrete resistors between various gun components, see U.S. Pat. No. 4,345,185 and Japanese application No. 40,12432). (For getters placed to avoid shorting of the internal coating or discrete resistors, see, for example, U.S. Pat. Nos. 3,979,633; 4,182,974; and 4,230,966).

High resistance coatings in the neck region can be effective "surge limiters" by suppressing arc currents during tube operation, but such coatings hinder high voltage conditioning during processing. U.S. Pat. No. 3,959,686 addresses this problem by placing the high resistance coating between two lower resistance coatings in the neck and the mask-screen areas, respectively. Two anode buttons are provided in the tube wall, one conventionally placed in the upper (low resistance) coating to provide the tube operating potential, and the other placed in the lower (low resistive) coating to provide the conditioning potential. Thus, the middle (high resistance) coating can function as a surge limiter without interfering with conditioning. However, such a tube structure is complex and expensive to produce.

Another problem associated with high resistance coatings in the neck region is that their effectiveness may be reduced or eliminated by the getter assembly or getter flash or both forming a conductive bridge across the coating. Solutions offered to avoid this problem include moving the getter away from the neck region, for example, to the mask (U.S. Pat. No. 3,979,633), and placing a resistor between the getter wand and the gun convergence cup (U.S. Pat. No. 4,101,803). Moving the getter to the mask results in getter flash deposits on the back side of the mask. This is, of course, undesirable in the feedback CCRT. Placing a resistor between the wand and the cup risks shorting of the resistor, unless the getter flash is directed away from the resistor, i.e., toward the mask (U.S. Pat. No. 3,355,617).

SUMMARY OF THE INVENTION

Accordingly, it is an object of this invention to provide a CCRT which incorporates an arc suppression structure which avoids the disadvantages of the prior art, and which is compatible with the feedback features of a feedback CCRT.

In accordance with the invention, a CCRT incorporates an arc suppression coating in the neck region of the tube, and a getter structure on an internal magnetic shield (IMS) attached to the mask. The getter structure is constructed and positioned to achieve a getter flash distribution which substantially avoids the mask and neck regions of the tube, and the window region of a feedback CCRT. Thus, sufficient getter flash is obtained for acceptable tube life, while the arc suppression features as well as the feedback features of the tube are substantially preserved.

DETAILED DESCRIPTION

Figure 1:
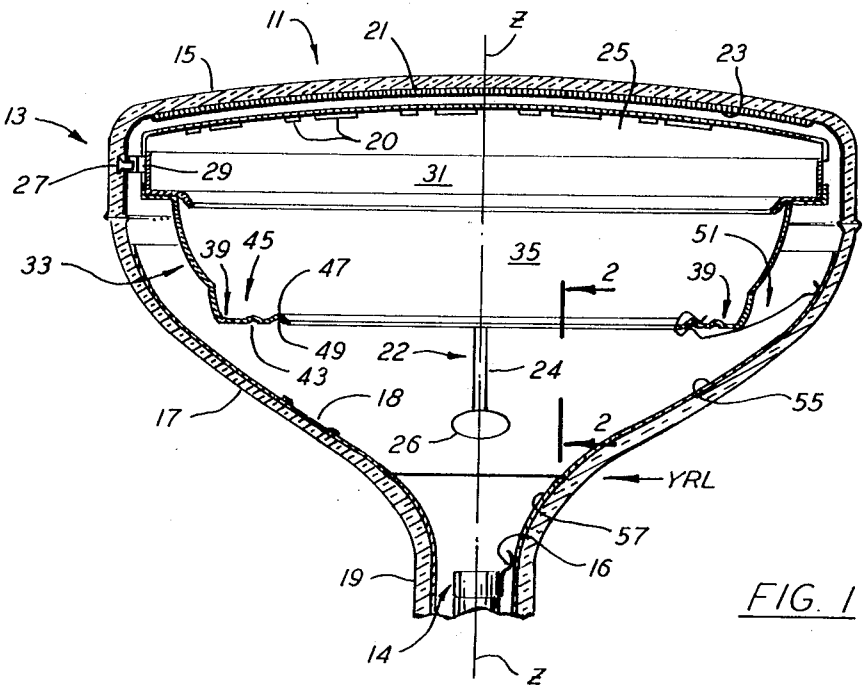
FIG. 1 is a cross-section of one embodiment of a color cathode ray tube of the invention.

The cathode ray tube 11, shown in FIG. 1, is an exemplary color tube having a longitudinal Z axis and embodying an envelope 13 comprised of an integration of viewing panel 15, funnel 17 and neck 19 portions. Adhered to the inner surface of the viewing panel 15 is a patterned cathodoluminescent screen 21 formed of a multitude of discrete areas of color-emitting phosphor materials. A thin metallized film 23, such as aluminum, is usually applied over the interior surface of the screen and a portion of the sidewall area of the panel. A multi-apertured structure or aperture mask member 25 is spatially related to the patterned screen 21 being positioned within the viewing panel 15 by a plurality of stud-like mask supporting members 27 partially embedded in the panel sidewall in spaced-apart orientation. Mating with these supporting studs are a like number of mask locator means 29 which are suitably affixed to the frame portion 31 of the mask member 25. Mask member 25 directs the electron beams from plural beam electron gun 14 to the desired phosphor elements on screen 21.

Securely attached to the rear portion of the mask frame, as by a plurality of clips or welds, is an internal magnetic shielding member (IMS) 33 for shielding the beams from external stray magnetic fields. This structure, formed of a thin metal such as cold rolled steel, is shaped to evidence a continuous contoured bowl-like sidewall enclosure 35 having front and rear openings. The rear opening in the shielding member 33 is defined by ledge 39 extending inward from the sidewall enclosure 35 towards the Z axis. Narrow channels 43 and 49 formed in the ledge element 45 of the shielding member 33 strengthen the ledge element and also cooperate with contactor member 51 fabricated of a metallic spring material, for example stainless steel, to effect contact with the conductive coating 55 disposed on the interior surface of the funnel 17.

Coating 55 extends from the forward portion of funnel 17 to the yoke reference line (YRL), which line aids in the proper external placement of the magnetic deflection yoke, not shown. Contiguous internal arc suppression coating 57 extends from the YRL into the neck 19 where it makes electrical contact with gun 14 by way of snubber 16. Coatings 55 and 57 can be abutting, as shown, or overlapping, to achieve the necessary electrical continuity between them. A phosphor pattern on the back of mask 25, denoted by elements 20, emits radiation toward the rear of the tube upon being struck by electron beams from gun 14. Window 18 in coating 55 passes some portion of this radiation to an externally placed detector such as a photomultiplier tube.

Metallic getter assembly 22 includes getter wand 24 attached to IMS 33 and getter container 26 attached to wand 24, containing a getter material to be flashed during tube manufacture. Getter materials and flash techniques are well known in the art. Getter materials are primarily barium compounds and are conventionally flashed by placing an RF heating coil near the outside wall of the funnel adjacent the getter container after the tube has been exhausted and sealed, and heating to vaporize the material. The getter assembly 22 can be attached to the shield 33 prior to frit sealing of the mask-shield-face panel assembly to the funnel, in which case a "bakable getter" able to withstand frit sealing temperatures is employed. Alternatively, the getter assembly 22 can be attached after frit sealing by inserting through neck 19 and clipping onto shield 33, in which case a conventional non-bakable getter may be employed.

Coating 55 is preferably of the conventional "hard dag" type, composed of finely divided graphite, iron oxide, an alkali metal silicate binder and a dispersant. Such a coating will typically exhibit a static resistance (measured point-to-point when the tube is non-operational) in the range of about 600 to 1500 ohms, depending upon a variety of factors such as coating composition, thickness, uniformity, etc. The coating may be brushed, sprayed or flowed onto the funnel, although flow coating requires a well-dispersed, non-viscous composition. Window 18 is preferably formed prior to application of coating 55, by application of a material such as tin-antimony resinate, and by baking to convert the resinate to an oxide. Window 18 is kept clear by adhering a temporary mask to it prior to applying the coating 55. After the coating has dried, the mask is removed.

Coating 57 is an arc limiting coating and thus preferably exhibits a higher static resistance than coating 55, for example, 6,000 ohms to 1 megohm ($10^6$ ohms). A variety of suitable arc limiting coatings are known, such as metal oxide-containing frit compositions and modified dag compositions, some of which are referenced herein, in which iron oxide may be replaced by other metal oxides such as chromium oxide, aluminum oxide and titanium dioxide. Any of these compositions are suitable for use in the invention provided they exhibit resistance values within the desired range. While coatings with resistances up to 1 megohm may be used, it is preferred to employ coatings with resistances which do not exceed about 50,000 ohms, above which high voltage conditioning is difficult to achieve without risking damage to internal tube components.

Figure 2:
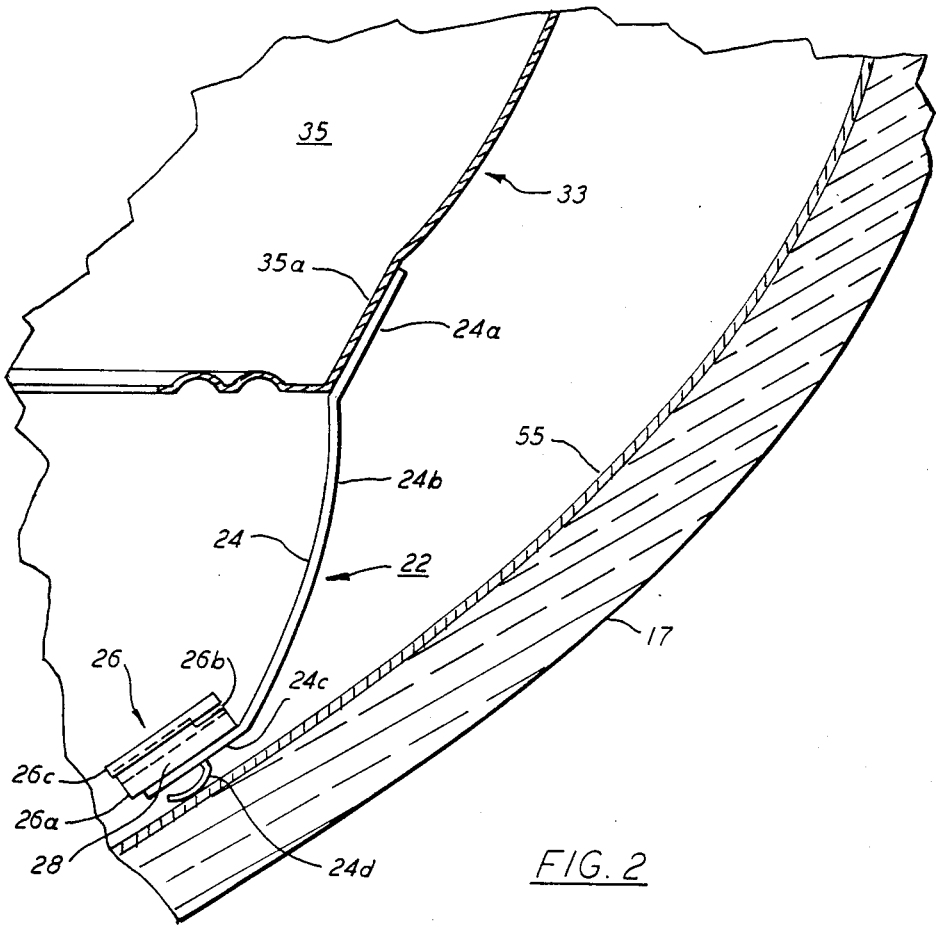
FIG. 2 is an enlarged portion of the tube of FIG. 1, taken along section 2—2, detailing a portion of the invention embodiment.

Referring now to FIG. 2, there is shown an enlarged section view along section 2—2 of a portion of the tube of FIG. 1, showing a side view of getter assembly 22. Wand 24 is made of a metallic spring material, such as stainless steel, and has three sections 24*a*, 24*b* and 24*c*, defined by two transverse bends in the wand. Flat section 24*a* is attached, for example, by spot welds, to a flat portion 35*a* of the sidewall enclosure 35 of IMS 33. Flat section 24*c* is similarly attached to getter container 26. Central section 24*b* is flexed from a flat to a curved configuration upon insertion of the getter assembly 22 into funnel 17. The resulting spring bias of wand 24 insures firm electrical contact between getter assembly 22 via skids 24*d*, and internal coating 55. In addition to providing contact, skids 24*d* allow the getter assembly 22 to slide along coating 55 during insertion. Getter container 26 includes cup 26*a* having a cylindrical wall forming a slot-shaped aperture 26*b*. Lid 26*c* also has a cylindrical wall, and is dimensioned to telescope over a top portion of the cup and partially close aperture 26*b*. Cup 26*a* is shown partially filled with getter material 28, which when flashed is directed up between funnel 17 and IMS 33, and away from neck 19.

Figure 3:
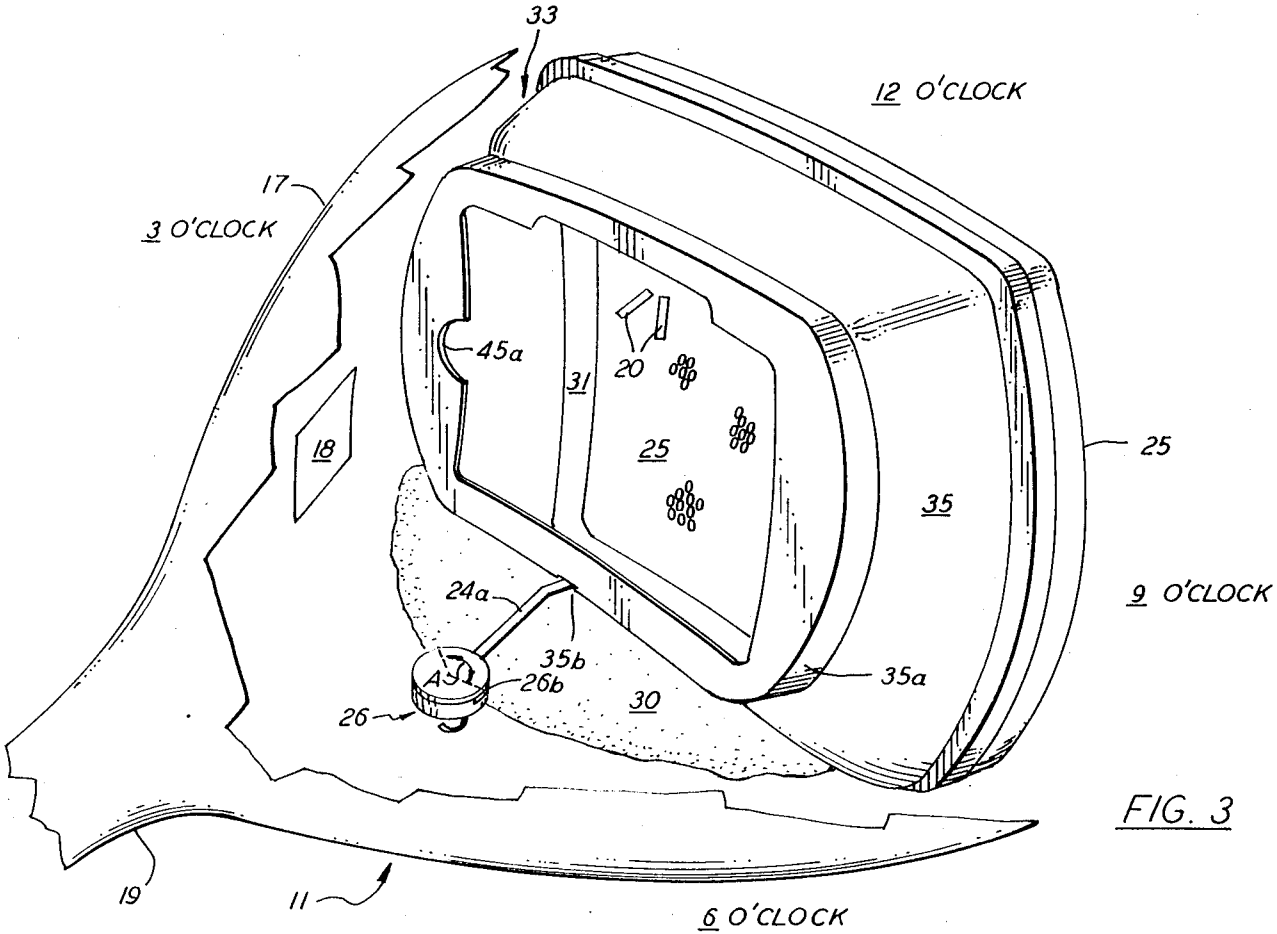
FIG. 3 is a perspective view, partly cut away, of a portion of the tube of FIG. 1, illustrating a typical getter flash deposit.

Referring now to FIG. 3, there is shown a perspective view, partly cut away, of the tube 11 of FIG. 1, after getter 28 has been flashed. As will be appreciated, the lateral distribution of getter deposit 30 is controlled by the extent of elongation of slot 26*b*, defined either by angle A, formed between the slot ends and the cup center, or by the fraction of the cup circumference removed by the slot. The value of A preferably ranges between 45° and 180° (corresponding to a fractional value between $\frac{1}{8}$ and $\frac{1}{2}$), in order to provide sufficient getter for adequate tube life while avoiding substantial interference with window 18.

It is conventional practice to refer to tube orientation as if the mask or screen were the face of an analog clock. Thus, FIG. 3 shows 3, 6, 9 and 12 o'clock sides of mask 25. It is convenient to refer to adjacent sides of funnel 17 in the same manner. Thus, getter flash 30 is distributed primarily on the 6 o'clock side, while window 18 is located on the 3 o'clock side. During conditioning and tube operation, the high voltage potential is applied via an anode button, not shown in the 12 o'clock side.

The proper orientation of getter wand 24 on shield wall 35*a* may be facilitated, if desired, by forming a channel 35*b* in wall 35*a*.

While there has been shown and described what are at present considered the preferred embodiments of the invention, it will be obvious to those skilled in the art that various changes and modifications may be made therein without departing from the scope of the invention as defined by the appended claims.

For example, the described arc limiting features, while especially useful in CCRTs having feedback features, may also benefit conventional CCRTs without such feedback features.

What is claimed is:

1. A color cathode ray tube comprising a glass envelope of integrated neck, funnel and face panel portions, a plural beam electron gun in the neck portion, a phosphor screen having a plurality of phosphor elements on the interior surface of the face panel portion, an aperture mask adjacent the screen for directing the electron beams to the desired phosphor elements, a phosphor pattern on the gun side of the mask, an internal magnetic shield attached to the aperture mask for shielding the beams from external stray magnetic fields, the shield comprising a sidewall enclosure having a contoured portion and a flat portion, the shield also comprising a ledge extending inward from the flat portion of the sidewall enclosure, a conductive coating on the interior surface of the glass envelope to provide electrical connection between the terminal portion of the gun and the mask, an electrically conductive window in the conductive coating on one side of the funnel to allow external detection of emissions from the mask phosphor, and a getter assembly for flashing a getter deposit inside the tube, characterized in that:

(a) the conductive coating comprises a first coating substantially in the forward portion of the funnel and a second arc suppression coating in contact with the first coating and extending substantially into the neck region of the tube, and (b) the getter assembly comprises a getter container and wand, the wand having two flat sections and a central section, one flat section attached to the flat portion of the shield sidewall enclosure, and the other flat section attached to said getter container, said getter container in contact with the first conductive coating on a side of the funnel other than the window side, said getter container defining an aperture elongated in a direction substantially normal to the length dimension of the wand, said aperture facing the forward portion of the funnel, whereby upon getter flash, the getter deposit is distributed substantially along the forward portion of the side of the funnel and the facing side of the magnetic shield away from the window side.

2. The color cathode ray tube of claim 1 wherein the first conductive coating exhibits a static resistance of from about 600 to 1500 ohms, and the second conductive coating exhibits a static resistance of from about 6,000 ohms to 1 megohm.

3. The color cathode ray tube of claim 2 wherein the second conducitve coating exhibits a static resistance of from about 6,000 to 50,000 ohms.

4. The color cathode ray tube of claim 1 wherein said getter container has a substantially cylindrical sidewall portion and substantially planar top and bottom portions, and the aperture is located in the sidewall portion and extends from one-eighth ($\frac{1}{8}$) to one-half ($\frac{1}{2}$) of the wall circumference.

5. The color cathode ray tube of claim 4 wherein the aperture is slot-shaped.

6. The color cathode ray tube of claim 4 wherein said getter container comprises a cup having the aperture in its sidewall, and a lid attached to the cup.

* * * * *